US008425341B2

(12) United States Patent
Takechi et al.

(10) Patent No.: US 8,425,341 B2
(45) Date of Patent: Apr. 23, 2013

(54) WOOD TYPE GOLF CLUB HEAD

(75) Inventors: Takaharu Takechi, Chichibu (JP); Yasunori Imamoto, Chichibu (JP); Tomoe Watanabe, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 255 days.

(21) Appl. No.: 12/849,318

(22) Filed: Aug. 3, 2010

(65) Prior Publication Data

US 2011/0034262 A1 Feb. 10, 2011

(30) Foreign Application Priority Data

Aug. 4, 2009 (JP) ..... 2009-181531
Aug. 4, 2009 (JP) ..... 2009-181532

(51) Int. Cl.
*A63B 69/36* (2006.01)
*A63B 53/04* (2006.01)

(52) U.S. Cl.
USPC ..... 473/242; 473/249; 473/324; 473/331

(58) Field of Classification Search ..... 473/219–256, 473/324–350; D21/733, 735, 751, 759
See application file for complete search history.

(56) References Cited

U.S. PATENT DOCUMENTS

D89,332 S * 2/1933 Bartsch ..... D21/733
2,842,369 A * 7/1958 East ..... 473/242
4,136,877 A 1/1979 Antonious
4,458,900 A 7/1984 Antonious
4,809,977 A * 3/1989 Doran et al. ..... 473/249
5,709,617 A * 1/1998 Nishimura et al. ..... 473/330
5,830,084 A 11/1998 Kosmatka
5,851,160 A 12/1998 Rugge et al.
5,971,868 A 10/1999 Kosmatka
6,007,432 A 12/1999 Kosmatka
D425,159 S * 5/2000 Helmstetter et al. ..... D21/759
6,478,693 B2 11/2002 Matsunaga et al.
6,719,644 B2 4/2004 Beach
6,773,359 B1 8/2004 Lee
6,793,588 B2 9/2004 Tang et al.
6,800,038 B2 10/2004 Willett et al.
6,824,475 B2 11/2004 Burnett et al.
6,997,820 B2 2/2006 Willett et al.
7,066,832 B2 6/2006 Willett et al.
7,118,491 B2 10/2006 Mootoo (Continued)

FOREIGN PATENT DOCUMENTS

JP 5-171 U 1/1993
JP 5-21976 U 3/1993

(Continued)

OTHER PUBLICATIONS

Japanese Office Action issued in Japanese Application No. 2009-181532 dated Jan. 29, 2013.

(Continued)

*Primary Examiner* — Sebastiano Passaniti
(74) *Attorney, Agent, or Firm* — Sughrue Mion, PLLC

(57) ABSTRACT

A wood type golf club head according to this invention includes a face portion and a crown portion. A center-of-gravity position mark which indicates a point where the center of gravity of the wood type golf club head is projected to the crown portion is formed on the surface of the crown portion.

17 Claims, 6 Drawing Sheets

U.S. PATENT DOCUMENTS

| | | | | |
|---|---|---|---|---|
| 7,147,569 | B2 | 12/2006 | Tang et al. | |
| 7,207,898 | B2 | 4/2007 | Rice et al. | |
| 7,214,142 | B2 | 5/2007 | Meyer et al. | |
| 7,258,625 | B2 | 8/2007 | Kawaguchi et al. | |
| 7,563,175 | B2 | 7/2009 | Nishitani et al. | |
| 7,563,178 | B2 | 7/2009 | Rae et al. | |
| 7,828,669 | B1 * | 11/2010 | Stites | 473/219 |
| 2002/0082117 | A1 | 6/2002 | Nishitani et al. | |
| 2005/0009633 | A1 | 1/2005 | Rice et al. | |
| 2006/0111198 | A1 | 5/2006 | Matsunaga | |
| 2007/0173346 | A1 | 7/2007 | Chiang et al. | |

FOREIGN PATENT DOCUMENTS

| | | | |
|---|---|---|---|
| JP | 6-305241 | A | 11/1994 |
| JP | 9-154985 | A | 6/1997 |
| JP | 10-33725 | A | 2/1998 |
| JP | 10-234894 | A | 9/1998 |
| JP | 10-248963 | A | 9/1998 |
| JP | 2001-508333 | A | 6/2001 |
| JP | 2001-286586 | A | 10/2001 |
| JP | 3244262 | B2 | 10/2001 |
| JP | 2001-346918 | A | 12/2001 |
| JP | 2002-136626 | A | 5/2002 |
| JP | 3352351 | B2 | 9/2002 |
| JP | 2003-169869 | A | 6/2003 |
| JP | 2003-299753 | A | 10/2003 |
| JP | 2004-142343 | A | 5/2004 |
| JP | 2004-358225 | A | 12/2004 |
| JP | 2005-28170 | A | 2/2005 |
| JP | 2005-81122 | A | 3/2005 |
| JP | 2005-224427 | A | 8/2005 |
| JP | 2005-270180 | A | 10/2005 |
| JP | 2006-149449 | A | 6/2006 |
| JP | 2007-195935 | A | 8/2007 |
| JP | 2007-325859 | A | 12/2007 |
| JP | 4247838 | B2 | 1/2009 |
| JP | 2010-119483 | A | 6/2010 |
| WO | 98/29163 | A1 | 7/1998 |

OTHER PUBLICATIONS

Japanese Office Action issued in Japanese Application No. 2009-181531 dated Feb. 12, 2013.

* cited by examiner

WOOD TYPE GOLF CLUB HEAD

BACKGROUND OF THE INVENTION

1. Field of the Invention

The present invention relates to a wood type golf club head.

2. Description of the Related Art

In one conventional golf club where a mark for assisting the golfer in having a swing is formed on the club head surface, a straight line that indicates the impact direction, and a straight line in a direction perpendicular to the former straight line are inscribed on the club head surface (Japanese Utility Model Laid-Open No. 5-21976). In the golf club disclosed in Japanese Utility Model Laid-Open No. 5-21976, the above-mentioned mark allows the golfer to easily, correctly address a golf ball in its target impact direction with the club face, and therefore allows him or her to hit the ball in a precise direction.

The head's center of gravity plays an important role in determining the performance of a golf club. The center of weight of the head serves as the center of gravity. Also, a point where a perpendicular line dropped from the center of gravity to the face intersects with the face serves as a sweet spot (the center of gravity corresponding to the face), and a predetermined area with the sweet spot almost as its center serves as a hitting area (sweet area). The lower the center of gravity, the higher a ball easily launches, and the deeper the center of gravity, the larger both the moment of inertia and the sweet area. As can be seen from these and other examples, the center of gravity exerts a great influence on ball trajectory determination and the club's playability.

Hence, to allow the golfer to have a stable swing, it is important for him or her to pay attention to the head's center-of-gravity position at the time of address and swing.

However, since the mark inscribed on the surface of the golf club head disclosed in Japanese Utility Model No. 5-21976 includes a straight line that indicates the impact direction, and a straight line perpendicular to the former straight line, the golfer can pay attention to the impact direction and the face orientation, but cannot pay attention to the head's center-of-gravity position.

SUMMARY OF THE INVENTION

It is an object of the present invention to provide a wood type golf club head that allows the golfer to readily pay attention to the head's center-of-gravity position.

According to an aspect of the present invention, there is provided a wood type golf club head including a face portion and a crown portion, wherein a center-of-gravity position mark which indicates a point where a center of gravity of the wood type golf club head is projected to the crown portion is formed on a surface of the crown portion.

According to another aspect of the present invention, there is provided a wood type golf club head including a face portion, wherein a center-of-gravity position mark which indicates a point where a center of gravity of the wood type golf club head is projected to the face portion is formed in the face portion by one of a blasting method and a YAG laser irradiation method.

According to still another aspect of the present invention, there is provided a wood type golf club head including a face portion and a crown portion, wherein a first center-of-gravity position mark which indicates a point where a center of gravity of the wood type golf club head is projected to the crown portion is formed on a surface of the crown portion, and a second center-of-gravity position mark which indicates a point where the center of gravity is projected to the face portion is formed in the face portion.

Further features of the present invention will become apparent from the following description of exemplary embodiments with reference to the attached drawings.

DESCRIPTION OF THE EMBODIMENTS

<First Embodiment>

Figure 1:
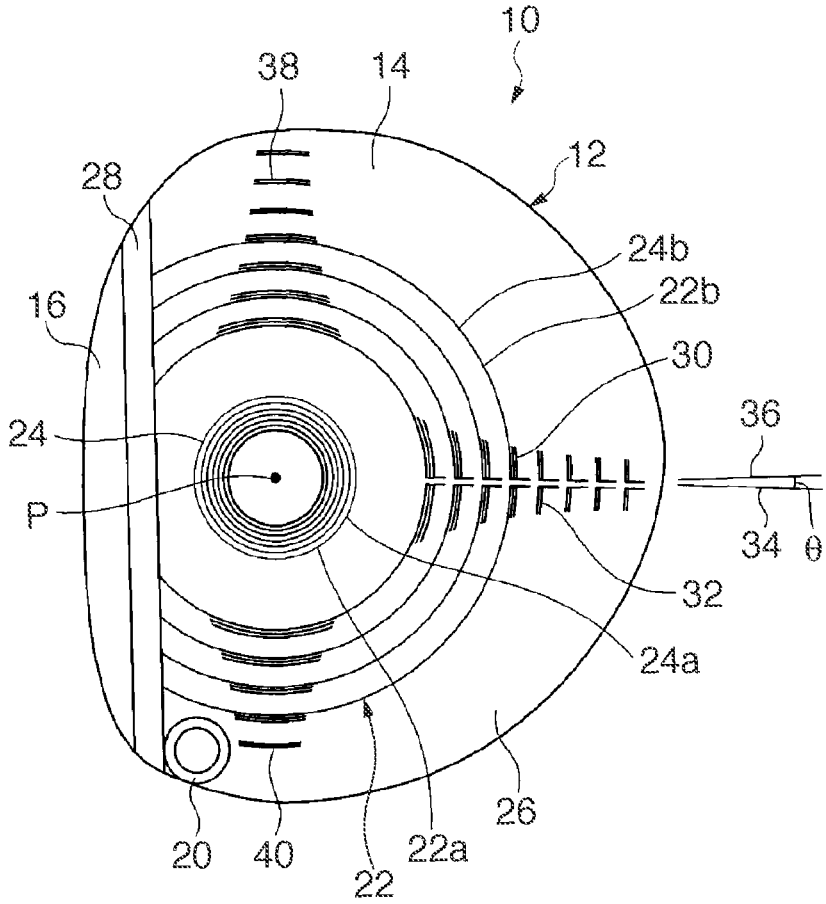
FIG. 1 is a plan view showing a wood type golf club head according to the first embodiment of the present invention when viewed from the crown side.
Figure 2:
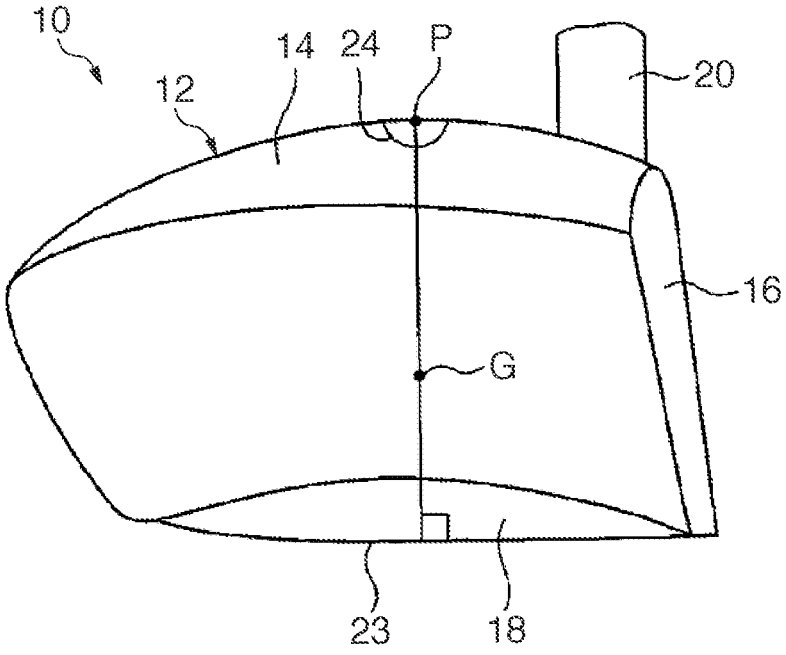
FIG. 2 is an explanatory view showing the principle of the wood type golf club head according to the first embodiment when viewed from the toe side.

FIG. 1 is a plan view showing a wood type golf club head (driver head) according to the first embodiment of the present invention when viewed from the crown side. FIG. 2 is an explanatory view showing the principle of the wood type golf club head according to the first embodiment when viewed from the toe side.

In a golf club head 10 according to this embodiment, reference numeral 12 denotes a hollow head body; 14, a crown portion; 16, a face portion; 18, a sole portion; and 20, a hosel portion. The material of the head body 12 is not particularly limited, and can be, for example, a fiber-reinforced resin or a metal such as titanium, a titanium alloy, stainless steel, aluminum, an aluminum alloy, a beryllium copper alloy, or a magnesium alloy.

In the golf club head 10 according to this embodiment, a visible center-of-gravity position mark 22 which indicates a point P where a head's center of gravity G is projected to the crown portion 14 is formed on the surface of the crown portion 14. The point P is a small region that is or includes a point where a straight line which is perpendicular to a sole surface 23 and passes through the center of gravity G intersects with the crown portion 14. The center-of-gravity position mark 22 includes a plurality of concentric circles 24 with the point P as a center.

More specifically, the center-of-gravity position mark 22 includes an inner concentric circle arrangement portion 22*a* and outer concentric circle arrangement portion 22*b*. In the inner concentric circle arrangement portion 22*a*, a plurality of concentric circles 24*a* which have small diameters and the point P as a center are formed at a short interval. In the outer concentric circle arrangement portion 22*b*, a plurality of concentric circles 24*b* which have large diameters and the point P as a center are formed at a slightly long interval. In this case, the innermost circle 24 of the center-of-gravity position mark 22 surrounds the position of the point P, where the head's center of gravity G is projected to the crown portion 14, when the golf club head 10 is set at a lie angle of 57° to 63°. This is because a driver head generally has a lie angle of around 60°, and this means that by setting the point P when the golfer addresses a ball at a lie angle of 57° to 63° to fall within the innermost circle 24, the center-of-gravity position mark 22 allows many golfers to pay attention to the center-of-gravity position. The diameter of the innermost circle 24 is preferably within a range of 5 mm to 25 mm. A more preferable value of the diameter of the innermost circle 24 is 17 mm. The innermost circle 24 may be a hollow or filled circle.

The center-of-gravity position mark 22 according to this embodiment allows the golfer to pay attention to the point P, which is the center of the plurality of concentric circles 24, as a center-of-gravity position. Note that although the point P is indicated by filled circles in FIGS. 1 and 2, no mark which indicates the point P itself is inscribed on an actual club. Note also that FIG. 2 shows only the innermost circle 24 of the center-of-gravity position mark 22.

In the golf club head 10 according to this embodiment, the crown portion 14 has, in portions other than its face-side edge, a colored portion 26 painted in colors such as black, blue, green, gray, or red as needed, and has, in its face-side edge, an uncolored portion 28 which is not colored and therefore has its metal exposed from it. The colored portion 26 is colored such that the color is lightest in the vicinity of the point P and gradually darkens outward.

Since this coloring configuration also features the center-of-gravity position mark in the present invention, it allows the golfer to pay attention to the portion with the lightest color as a center-of-gravity position. Note that the uncolored portion 28 in which the metal is exposed is provided in the face-side edge of the crown portion 14 in order to match the color of the uncolored portion 28 with that of the face portion 16. Thus, the face portion 16 shows its large area to the golfer upon address, thereby giving a sense of reassurance to him or her.

In the golf club head 10 according to this embodiment, a take-back line mark 30 which indicates the take-back direction is formed on the surface of the crown portion 14 in the back direction using the outer edge of the inner concentric circle arrangement portion 22*a* of the center-of-gravity position mark 22 as a base point. The take-back line mark 30 is formed by aligning roughly L-shaped patterns 32 along a precise take-back line, and the patterns 32 get smaller toward the back side. Also, since the golf club head 10 according to this embodiment is a hook face head, the angle θ between a center line 34 of the take-back line mark 30, and a straight line 36 perpendicular to the face surface is 1° to 5° and preferably is 2° to 4°.

In the golf club head 10 according to this embodiment, a toe-to-heel line mark 38 which indicates the toe-to-heel direction is formed on the surface of the crown portion 14. The toe-to-heel line mark 38 includes a toe-side mark 38*a* extending in the toe direction using the outer edge of the inner concentric circle arrangement portion 22*a* of the center-of-gravity position mark 22 as a base point, and a heel-side mark 38*b* extending in the heel direction using that outer edge as a base point. The toe-to-heel line mark 38 is formed by aligning arcuated patterns 40 in the toe-to-heel direction, and the patterns 40 get smaller toward the toe and heel sides. The toe-to-heel line mark 38 is formed aiming to, for example, allow the golfer to notice the center-of-gravity position in the toe-to-heel direction, allow him or her to pay careful attention to the center-of-gravity position, accentuate a feeling of square upon address, and improve the design performance.

In the golf club head 10 according to this embodiment, the center-of-gravity position mark 22, take-back line mark 30, and toe-to-heel line mark 38 are formed by creating the concentric circles 24, roughly L-shaped patterns 32, and arcuated patterns 40 with line widths of 0.1 to 0.5 mm using a method of scraping off the paint with laser light (burn-off). However, the pattern forming method is not limited to this, and these patterns can be formed using a method such as transfer sealing (water transfer), selective painting, or blasting.

The golf club head 10 according to this embodiment allows the golfer to focus attention on the head's center-of-gravity position and the take-back direction using a combination of colors or patterns, and therefore allows him or her to have a stable swing.

Figure 3:
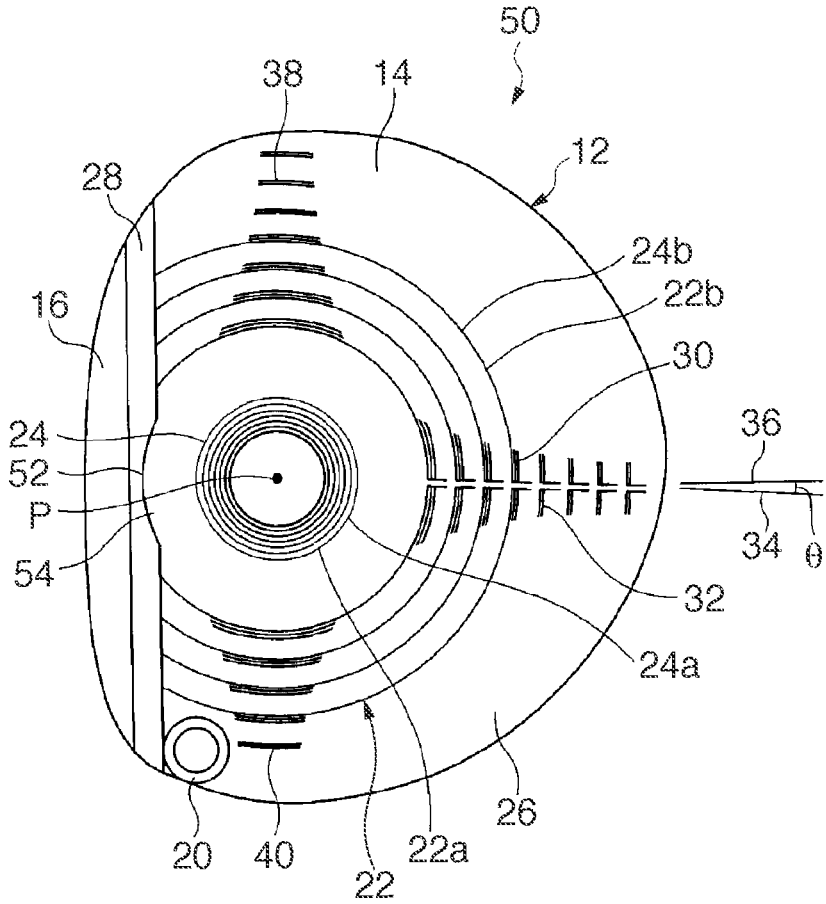
FIG. 3 is a plan view showing another arrangement of the golf club head according to the first embodiment when viewed from the crown side.

FIG. 3 is a plan view showing another arrangement of the golf club head according to the first embodiment when viewed from the crown side. A golf club head 50 shown in FIG. 3 is provided with a colored portion 54. The colored portion 54 has, on its outer edge, an arc 52 as a part of a circle with the point P as a center, so as to continue to the colored portion 26 of the crown portion 14 and enter the uncolored portion 28 in the golf club head shown in FIG. 1. The golf club head 50 shown in FIG. 3 more effectively allows the golfer to pay attention to the center-of-gravity position using the colored portion 54. Note that the same reference numerals as in FIG. 1 denote the same constituent components in FIG. 3, and a description thereof will not be given.

The golf club head according to the present invention is not limited to the above-described embodiment, and various changes can be made without departing from the scope of the present invention. For example, although a center-of-gravity position mark is formed using a plurality of concentric circles with the point P as a center in the above-described embodiment, and a coloring configuration in which the color is lightest in the vicinity of the point P and gradually darkens outward, it may be formed using, for example, other patterns, colors, or three-dimensional shapes. Also, although a take-back line mark is formed using roughly L-shaped patterns in the above-described embodiment, it may be formed using, for example, other patterns, colors, or three-dimensional shapes.

<Summary of First Embodiment>

As described above, in the wood type golf club head according to the first embodiment, since a center-of-gravity position mark that indicates the head's center-of-gravity position is formed on the surface of the crown portion, it allows the golfer to pay attention to the center-of-gravity position, and therefore allows him or her to have a stable swing. In this case, the center-of-gravity position mark allows the golfer to notice a shift between the shaft axis and the head's center-of-gravity position, and therefore to pay attention to a precise head's center-of-gravity position at the time of take-back. Thus, the center-of-gravity position mark prevents the golfer from swinging late to bring about a stable swing trajectory, thereby realizing a stable line of flight of a ball with little variation.

Also, the center-of-gravity position mark is preferably formed on the surface of the crown portion so as to indicate a point where the head's center of gravity is projected to the crown portion, that is, a point where a straight line which is perpendicular to the sole surface and passes through the center of gravity intersects with the crown portion. The center-of-gravity position mark may be formed in the head's center-of-gravity projection point itself on the surface of the crown portion, or within an appropriate range including this point.

The arrangement of the center-of-gravity position mark is not particularly limited, and may take any form as long as it allows the golfer to pay attention to the head's center-of-gravity position at the time of swing. The center-of-gravity position mark can be a mark which indicates the head's center-of-gravity projection point on the surface of the crown portion in, for example, appropriate shapes (for example, three-dimensional shapes), appropriate patterns (for example, patterns formed in a circle, an ellipse, or a polygon), or appropriate colors (for example, specific colors or color density).

A preferable center-of-gravity position mark can be, for example, a mark which surrounds the head's center-of-gravity projection point on the surface of the crown portion in a single circular pattern or a plurality of concentric circular patterns with this point as a center, a mark whose painting color in the crown portion darkens in the direction from the head's center-of-gravity projection point on the surface of the crown portion to the outside, or a mark whose painting color in the crown portion lightens in the direction from the head's center-of-gravity projection point on the surface of the crown portion to the outside.

Also, in this embodiment, since a take-back line mark which indicates the take-back direction is formed on the surface of the crown portion using the center-of-gravity position mark as a base point, it allows the golfer to pay attention to the take-back direction at the time of swing, and therefore allows him or her to have a more stable swing.

In the golf club head having the above-mentioned take-back line mark, a center-of-gravity position mark which indicates the head's center-of-gravity position, and a take-back line mark which indicates the take-back direction are formed on the surface of the crown portion. Thus, the center-of-gravity position mark allows the golfer to pay attention to the center-of-gravity position, and the take-back line mark allows him or her to pay attention to the take-back direction. This means that these marks allow the golfer to have a more stable swing. In this case, the above-mentioned take-back line mark allows the golfer to pay attention to the take-back direction to assist him or her in having a smooth swing.

The above-mentioned take-back line mark extends along a precise take-back line using the central portion and edge portion of the center-of-gravity position mark or the intermediate portion between the central portion and edge portion. A take-back line mark is formed in one or both of the face and back directions from the center-of-gravity position mark, and is preferably formed in the back direction. The formation of a take-back line mark in the back direction from the center-of-gravity position mark makes it possible to produce an effect of assisting the golfer in paying attention to the take-back direction.

Also, the take-back line mark can be inclined by 1° to 5° to the heel or toe side with respect to the straight line perpendicular to the face surface in accordance with the type of head. That is, in a hook face head, when the take-back line mark is inclined by 1° to 5° to the heel side with respect to the straight line perpendicular to the face surface, the golfer can take back the club along the take-back line mark straight to the flight trajectory.

In a slice face head, when the take-back line mark is inclined by 1° to 5° to the toe side with respect to the straight line perpendicular to the face surface, the golfer can take back the club along the take-back line mark straight to the flight trajectory. In a square face head, when the take-back line mark is inclined by 1° to 5° to the heel side with respect to the straight line perpendicular to the face surface, the golfer can easily strike a hook ball by taking back the club along the take-back line.

In a square face head, when the take-back line mark is inclined by 1° to 5° to the toe side with respect to the straight line perpendicular to the face surface, the golfer can easily strike a slice ball by taking back the club along the take-back line mark.

The arrangement of the take-back line mark is not particularly limited, and may take any form as long as it allows the golfer to pay attention to the take-back line at the time of swing. The take-back line mark can be a mark which indicates the take-back line in, for example, appropriate shapes (for example, three-dimensional shapes), appropriate patterns (for example, patterns formed in a circle, an ellipse, or a polygon), or appropriate colors (for example, specific colors or color density). A preferable take-back line mark can be a mark which indicates the take-back line in continuous or intermittent patterns.

<Second Embodiment>

Figure 4:
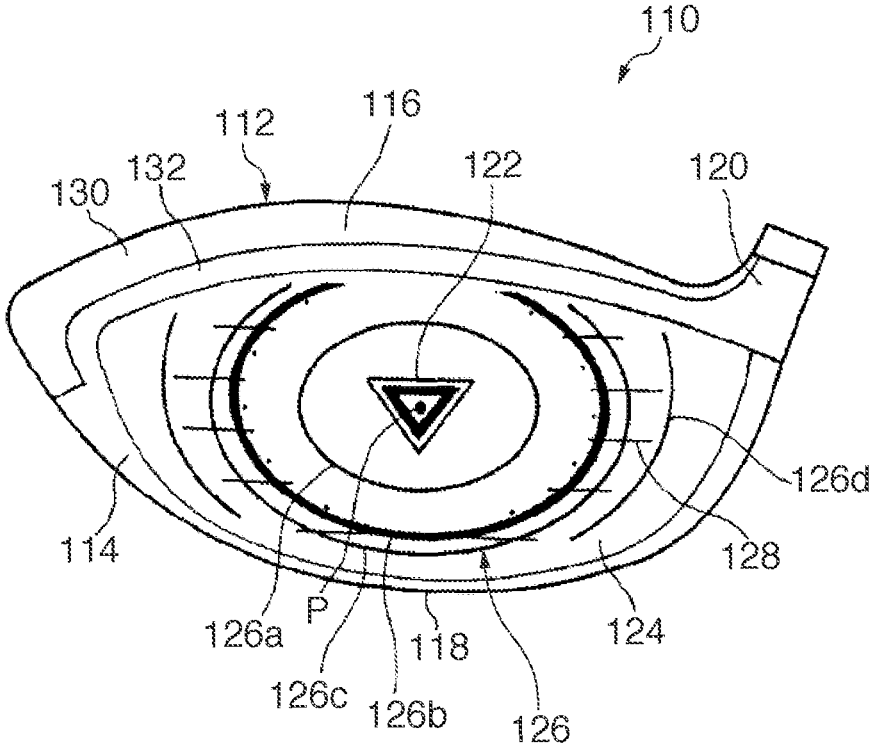
FIG. 4 is a front view showing a wood type golf club head according to the second embodiment of the present invention when viewed from the face side.
Figure 5:
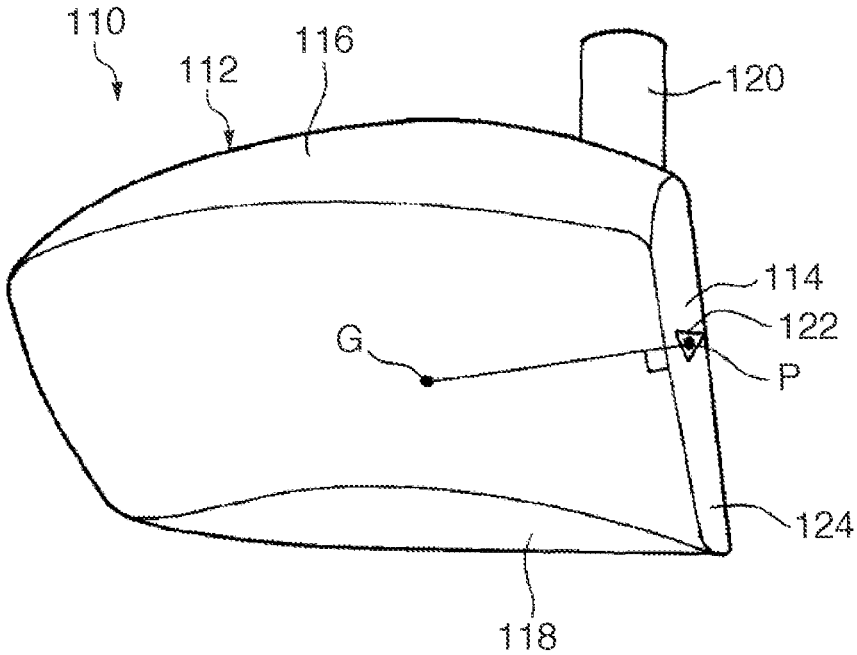
FIG. 5 is an explanatory view showing the principle of the wood type golf club head according to the second embodiment when viewed from the toe side.

FIG. 4 is a front view showing a wood type golf club head according to the second embodiment of the present invention when viewed from the face side. FIG. 5 is an explanatory view showing the principle of the wood type golf club head according to the second embodiment when viewed from the toe side.

In a golf club head 110 according to this embodiment, reference numeral 112 denotes a hollow head body; 114, a face portion; 116, a crown portion; 118, a sole portion; and 120, a hosel portion. The material of the head body 112 is not particularly limited, and can be, for example, a fiber-reinforced resin or a metal such as titanium, a titanium alloy, stainless steel, aluminum, an aluminum alloy, a beryllium copper alloy, or a magnesium alloy.

In the golf club head 110 according to this embodiment, a visible center-of-gravity position mark 122 which indicates a point P where a head's center of gravity G is projected to the face portion 114 is formed on a face surface 124 by a blasting method or a YAG laser irradiation method. The point P is a small region that is or includes a point where a straight line which passes through the center of gravity G intersects with the face portion 114 at right angles.

The center-of-gravity position mark 122 includes two concentric triangles with the point P as a center. The inner triangle has a line width wider than the outer triangle. The center-of-gravity position mark 122 according to this embodiment allows the golfer to notice the point P, where the center-of-gravity position mark 122 is located, as the hitting area of the face surface. Note that although the point P is indicated by filled circles in FIGS. 4 and 5, no mark which indicates the point P itself is inscribed on an actual club. Note also that FIG. 5 shows only the inner triangle of the center-of-gravity position mark 122.

In the golf club head 110 according to this embodiment, a peripheral mark 126 is formed on the face surface 124 by a blasting method or a YAG laser irradiation method so as to surround the center-of-gravity position mark 122 using the center-of-gravity position mark 122 as a center. More specifically, the peripheral mark 126 includes an innermost, first elliptical mark 126*a*, a second, nearly elliptical mark 126*b*, a third, nearly elliptical mark 126*c*, and an outermost, fourth, nearly elliptical mark 126*d*. The first elliptical mark 126*a* has a narrow line width. The second, nearly elliptical mark 126*b* is formed at a position slightly spaced apart from the first elliptical mark 126*a*, and has a wide line width. The third, nearly elliptical mark 126*c* is formed at a position close to the second, nearly elliptical mark 126*b*, and has a narrow line width. The fourth, nearly elliptical mark 126*d* is formed at a position close to the third, nearly elliptical mark 126*c*, and has a narrow line width. The peripheral mark 126 according to this embodiment allows the golfer to pay careful attention to a center-of-gravity position mark 212.

Assume that the center-of-gravity position mark 122 and peripheral mark 126 are formed by a blasting method. In this case, portions other than the center-of-gravity position mark 122 and peripheral mark 126 on the face surface 124 are masked, and the face surface 124 is blasted, to form three-dimensional patterns on the surfaces of the center-of-gravity position mark 122 and peripheral mark 126, thereby making the two marks 122 and 126 visible. Assume that the center-of-gravity position mark 122 and peripheral mark 126 are formed by a YAG laser irradiation method. In this case, the center-of-gravity position mark 122 and peripheral mark 126 on the face surface 124 are irradiated with YAG laser light to form three-dimensional patterns on the surfaces of the center-of-gravity position mark 122 and peripheral mark 126, thereby making the two marks 122 and 126 visible.

The golf club head 110 according to this embodiment has scorelines 128 formed in it. Nevertheless, the scorelines 128 are not formed in the center-of-gravity position mark 122 and its vicinity, and are formed only at positions considerably spaced apart from the center-of-gravity position mark 122. More specifically, the scorelines 128 are arranged so as to intersect with the second and third, nearly elliptical marks 126*b* and 126*c*.

The scorelines 128 are not formed in the center-of-gravity position mark 122 and its vicinity in order to highlight the center-of-gravity position mark 122 so that the golfer pays careful attention to the center-of-gravity position mark 22. In this case, although the scorelines 128 are not formed in the center-of-gravity position mark 122 and its vicinity, the center-of-gravity position mark 122 itself has a three-dimensional pattern, so in the rain the golfer can strike a wet ball with a back spin to prevent the flying ball from dropping.

Note that the scorelines 128 are generally formed with a width of about 0.7 to 0.9 mm and a depth of about 0.5 mm. The above-mentioned effect can similarly be obtained by setting the interval between the scorelines wider in the center-of-gravity position mark and its vicinity than in other portions.

Figure 6A:
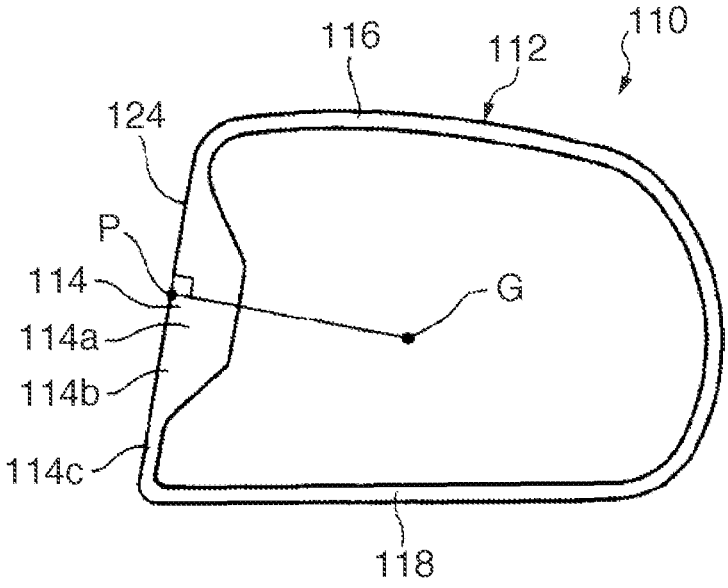
FIG. 6A is a sectional view showing the wood type golf club head according to the second embodiment.
Figure 6B:
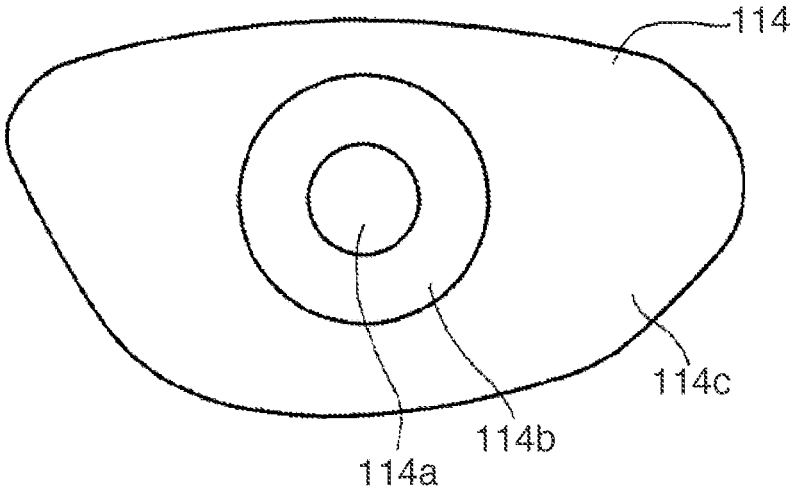
FIG. 6B is a back view showing the face portion of the wood type golf club head according to the second embodiment.

The face portion 114 of the golf club head 110 according to this embodiment includes a thick portion 114*a*, inclined portion 114*b*, and thin portion 114*c*, as shown in FIGS. 6A and 6B. The thick portion 114*a* has a maximum thickness in a portion including the center-of-gravity position mark 122. The inclined portion 114*b* has a thickness that gradually decreases toward its periphery. The thin portion 114*c* has a minimum thickness at its periphery. Thus, the repulsive force of the face portion 114 can be improved using flexure of the inclined portion 114*b* and thin portion 114*c* around the thick portion 114*a*, and the strength of the face portion 114 can be improved using the thick portion 114*a*.

Figure 7A:
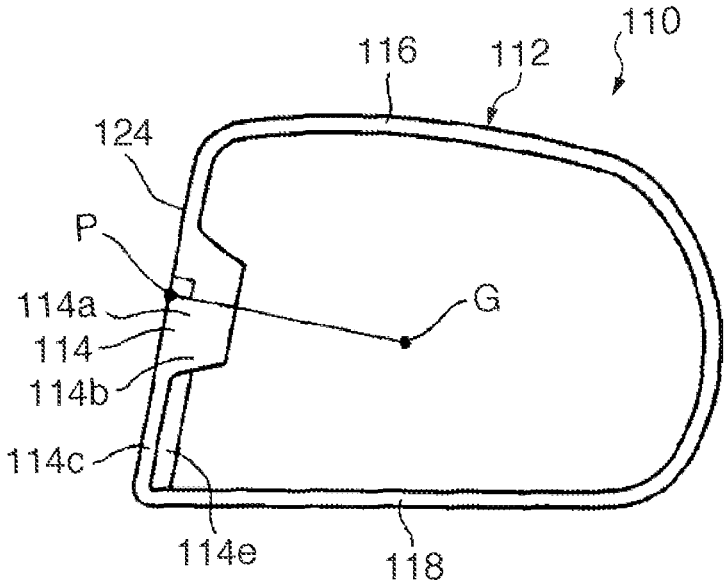
FIG. 7A is a sectional view showing another arrangement of the wood type golf club head according to the second embodiment.
Figure 7B:
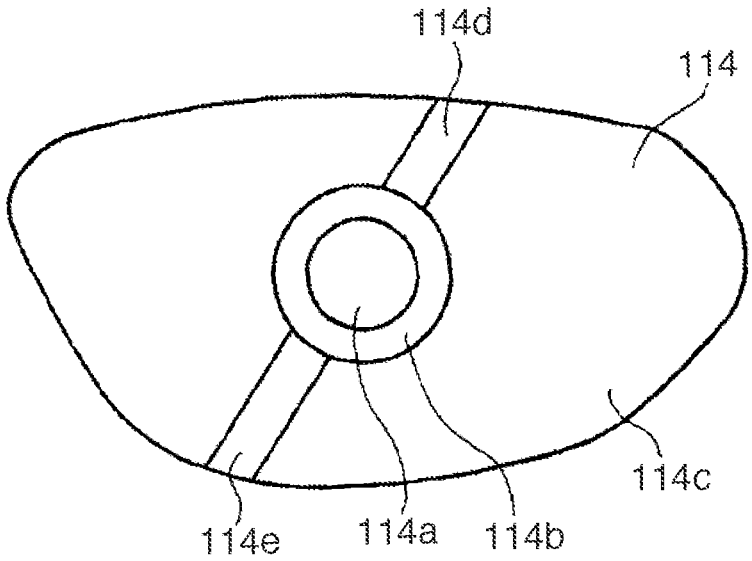
FIG. 7B is a back view showing the face portion of another arrangement of the wood type golf club head according to the second embodiment.

The face portion 114 of the golf club head 110 according to this embodiment may also have an arrangement shown in FIGS. 7A and 7B. The face portion 114 shown in FIGS. 7A and 7B includes not only a thick portion 114*a*, inclined portion 114*b*, and thin portion 114*c*, but also a projecting, upper rib 114*d* and projecting, lower rib 114*e*. The thick portion 114*a* has a maximum thickness in a portion including the center-of-gravity position mark 122. The inclined portion 114*b* has a thickness which gradually decreases toward its periphery. The thin portion 114*c* has a minimum thickness in its periphery. The upper rib 114*d* is formed between the inclined portion 114*b* and the crown-side edge with an inclination to the heel side. The lower rib 114*e* is formed between the inclined portion 114*b* and the sole-side edge with an inclination to the toe side.

Thus, the repulsive force of the face portion 114 can be improved using flexure of the inclined portion 114*b* and thin portion 114*c* around the thick portion 114*a*, and the strength of the face portion 114 can be improved using the thick portion 114*a*, upper rib 114*d*, and lower rib 114*e*. Note that the upper rib 114*d* is inclined to the heel side, and the lower rib 114*e* is inclined the toe side, in accordance with a variation in score of the average golfer, so they are designed to minimize repulsion loss at the time of off-center hit. The inclination angles of these ribs are nearly equal to lie angles set for the head.

In the golf club head 110 according to this embodiment, the crown portion 116 has, in portions other than its face-side edge, a colored portion 130 painted in colors such as black, blue, green, gray, or red as needed, and has, in its face-side edge, an uncolored portion 132 which is not colored and therefore has its metal exposed from it. The uncolored portion 132 in which the metal is exposed is formed in the face-side edge of the crown portion 116 in order to match the color of the uncolored portion 132 with that of the face portion 114. Thus, the face portion 114 shows its large area to the golfer upon address, thereby giving a sense of reassurance to him or her.

The golf club head 110 according to this embodiment allows the golfer to focus attention on the hitting area of the face surface using a combination of patterns, and therefore allows him or her to have a stable swing.

<Summary of Second Embodiment>

A predetermined area (typically a horizontally long elliptical area) with a point, where the head's center of gravity is projected to the face portion, almost as its center is a so-called hitting area (also called a sweet area). The golfer can obtain a large total distance upon striking a ball in the hitting area. In the wood type golf club head according to this embodiment, a center-of-gravity position mark which indicates the point, where the head's center of gravity is projected to the face portion, is formed in the face portion. This center-of-gravity position mark allows the golfer to pay attention to the hitting area including the center-of-gravity position of the face portion. Thus, the golfer can feel reassured upon address and therefore have a stable swing.

The center-of-gravity position mark in this embodiment is preferably formed on the face surface so as to indicate a point where the head's center of gravity is projected to the face portion, that is, a point where a straight line that passes through the center of gravity intersects with the face portion at right angles. The center-of-gravity position mark may be formed in the head's center-of-gravity projection point itself on the surface of the face portion, or within an appropriate range including this point. The arrangement of the center-of-gravity position mark is not particularly limited, and may take any form as long as it allows the golfer to pay attention to the head's center-of-gravity position upon address. A preferable center-of-gravity position mark can be a mark which surrounds the head's center-of-gravity projection point on the surface of the face portion in, for example, a single polygonal pattern (for example, a single triangular pattern, quadrangular pattern, or hexagonal pattern), circular pattern, or elliptical pattern with this point almost as its center, or a mark which surrounds the head's center-of-gravity projection point on the surface of the face portion in, for example, a plurality of concentric polygonal patterns (for example, a plurality of concentric triangular patterns, quadrangular patterns, or hexagonal patterns), concentric circular patterns, or concentric elliptical patterns with this point almost as its center. The above-mentioned mark can also be painted in colors as needed.

In this embodiment, the above-mentioned center-of-gravity position mark is formed by forming a three-dimensional pattern in the face portion by a blasting method or a YAG (yttrium/aluminum/garnet) laser irradiation method. This is because the durability of the center-of-gravity position mark can be increased by inscribing the center-of-gravity position mark in the face portion in a three-dimensional pattern. In contrast, if the center-of-gravity position mark is formed in the face portion by painting or a chemical treatment, it may wear out upon being struck by a ball.

In the blasting method mentioned earlier, a center-of-gravity position mark is formed to have a surface with a fine three-dimensional pattern by blasting small abrasive particles or the like against the face portion. In the YAG laser irradiation method, a center-of-gravity position mark is formed to have a surface with a fine three-dimensional pattern by irradiating the face portion with YAG laser light. One YAG laser light beam can generally form a three-dimensional pattern with a depth of 0.0005 to 0.1 mm in a portion with a width of 0.005 to 0.2 mm. Hence, a center-of-gravity position mark with an arbitrary shape can be obtained by irradiating an appropriate range in the face portion with YAG laser light. The width, area, and other characteristics of the center-of-gravity position mark can be set as needed, and lines which form this mark preferably have a width of 0.05 to 0.15 mm and a depth of 0.005 to 0.05 mm.

The wood type golf club head according to this embodiment can be designed such that a peripheral mark is formed in the face portion to surround the center-of-gravity position mark using the center-of-gravity position mark as a center. This allows the golfer to pay careful attention to the center-of-gravity position mark.

The wood type golf club head according to this embodiment can be designed such that scorelines (transverse grooves inscribed in the face surface) are not formed in the center-of-gravity position mark and its vicinity, or the interval between the scorelines is set wider in the center-of-gravity position mark and its vicinity than in other portions. This highlights the center-of-gravity position mark in the face portion, and therefore allows the golfer to pay careful attention to the hitting area. Also, although the scorelines are not formed in the center-of-gravity position mark and its vicinity, or the interval between the scorelines is set wider in the center-of-gravity position mark and its vicinity than in other portions, the center-of-gravity position mark itself has a three-dimensional pattern, so in the rain the golfer can strike a wet ball with a back spin to prevent the flying ball from dropping.

The wood type golf club head according to this embodiment can be designed such that a portion including the center-of-gravity position mark in the face portion is thicker than other portions. Thus, the repulsive force of the face portion can be improved using flexure of the thin portion around the thick portion, and the strength of the face portion can be improved using the thick portion.

The wood type golf club head according to this embodiment allows the golfer to pay attention to the hitting area of the face portion upon address using the center-of-gravity position mark formed in the face portion. Thus, the golfer can feel reassured upon address, and have a stable swing, thereby realizing a stable line of flight of a ball with little variation.

Because the center-of-gravity position mark is inscribed in the face portion in a three-dimensional pattern, which is formed by a blasting method or a YAG laser irradiation method, it has a durability high enough not to wear out upon being struck by a ball.

Because the hitting area of the face portion has the center-of-gravity position mark with a three-dimensional pattern formed in it, in the rain the golfer can strike a wet ball with a back spin to prevent the flying ball from dropping encountered at the time of impact.

<Third Embodiment>

The first and second embodiments can be combined as needed. For example, although a center-of-gravity position mark is formed in a crown portion or a face portion in the first and second embodiments, a first center-of-gravity position mark which indicates a point where the center of gravity of a golf club head is projected to a crown portion may be formed on the surface of the crown portion, and a second center-of-gravity position mark which indicates a point where the center of gravity of the golf club head is projected to a face portion may be formed in the face portion. In this case, the second center-of-gravity position mark may be formed in the face portion using a method other than a blasting method or a YAG laser irradiation method.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2009-181531, filed Aug. 4, 2009, and 2009-181532, filed Aug. 4, 2009, which are hereby incorporated by reference herein in their entireties.

What is claimed is:

1. A wood type golf club head including a face portion and a crown portion, wherein a center-of-gravity position mark which indicates a point where a center of gravity of the wood type golf club head is projected to the crown portion is formed on a surface of the crown portion, said center-of-gravity position mark includes a plurality of concentric circles, and said plurality of concentric circles includes:

a plurality of inner concentric circles at a first interval, and a plurality of outer concentric circles at a second interval longer than the first interval.

2. The head according to claim 1, wherein the innermost circle of said plurality of concentric circles surrounds a position of the point where the center of gravity is projected to the crown portion when the wood type golf club head is set at a lie angle of 57° to 63°.

3. The head according to claim 1, wherein a take-back line mark which indicates a take-back direction is formed on the surface of the crown portion using the center-of-gravity position mark as a base point.

4. The head according to claim 3, wherein the take-back line mark is formed in a back direction from the center-of-gravity position mark.

5. The head according to claim 3, wherein the take-back line mark is inclined by 1° to 5° to one of a heel side and a toe side of the wood type golf club head with respect to a straight line perpendicular to the face portion.

6. The head according to claim 1, wherein a toe-to-heel line mark which indicates a toe-to-heel direction is formed on the surface of the crown portion using the center-of-gravity position mark as a base point.

7. The head according to claim 1, wherein said center-of-gravity mark includes a colored portion which is colored such that a color is lightest in a vicinity of a position of the point where the center of gravity is projected to the crown portion and gradually darkens outward.

8. A wood type golf club head including a face portion, wherein a center-of-gravity position mark which indicates a point where a center of gravity of the wood type golf club head is projected to the face portion is formed in the face portion by one of a blasting method and a YAG laser irradiation method, scorelines are formed in the lace portion, the scorelines are not formed in the center-of-gravity position mark and a vicinity thereof, and said center-of-gravity position mark includes a straight line portion extending in a toe-to-heel direction.

9. The head according to claim 8, wherein a peripheral mark is formed in the face portion to surround the center-of-gravity position mark using the center-of-gravity position mark as a center.

10. The head according to claim 8, wherein said center-of-gravity position mark includes concentric triangles including said straight line portion.

11. The head according to claim 8, wherein said concentric triangles includes an inner triangle and an outer triangle, and said inner triangle has a line width wider than the outer triangle.

12. The head according to claim 8, wherein the face portion includes a portion which includes the center-of-gravity position mark and is thicker than other portions.

13. A wood type golf club head including a face portion and a crown portion, wherein a first center-of-gravity position mark which indicates a point where a center of gravity of the wood type golf club head is projected to the crown portion is formed on a surface of the crown portion, a second center-of-gravity position mark which indicates a point where the center of gravity is projected to the face portion is formed in the face portion, said first center-of-gravity position mark includes a plurality of concentric circles, and said plurality of concentric circles includes:

a plurality of inner concentric circles at a first interval, and a plurality of outer concentric circles at a second interval longer than the first interval.

14. The head according to claim 13, wherein the second center-of-gravity position mark is formed in the face portion by one of a blasting method and a YAG laser irradiation method.

15. The head according to claim 13, wherein a toe-to-heel line mark which indicates a toe-to-heel direction is formed on the surface of the crown portion using the first center-of-gravity position mark as a base point.

16. The head according to claim 13, wherein scorelines are formed in the face portion, the scorelines are not formed in the second center-of-gravity position mark and a vicinity thereof, and said second center-of-gravity position mark includes a straight line portion extending in a toe-to-heel direction.

17. The head according to claim 13, wherein said first center-of-gravity mark includes a colored portion which is colored such that a color is lightest in a vicinity of a position of the point where the center of gravity is projected the crown portion and gradually darkens outward.

* * * * *